United States Patent [19]

Jesseman

[11] Patent Number: 4,534,805

[45] Date of Patent: Aug. 13, 1985

[54] LOW ALLOY STEEL PLATE AND PROCESS FOR PRODUCTION THEREOF

[75] Inventor: Rodney J. Jesseman, Middletown, Ohio

[73] Assignee: Armco Inc., Middletown, Ohio

[21] Appl. No.: 535,542

[22] Filed: Sep. 26, 1983

Related U.S. Application Data

[63] Continuation of Ser. No. 476,353, Mar. 17, 1983, abandoned.

[51] Int. Cl.[3] ..... C21D 8/02

[52] U.S. Cl. ..... 148/12.3; 148/12 F; 148/12.4; 148/36

[58] Field of Search ..... 148/12 F, 12.3

[56] References Cited

U.S. PATENT DOCUMENTS

| | | | |
|---|---|---|---|
| 3,539,404 | 11/1970 | DeRetana | 148/12.4 |
| 3,692,514 | 9/1972 | Hydrean | 75/125 |
| 3,726,723 | 4/1973 | Coldren et al. | 148/12 F |
| 4,184,898 | 1/1980 | Ouchi et al. | 148/36 |
| 4,388,123 | 6/1983 | Murayama | 148/36 |

FOREIGN PATENT DOCUMENTS

| | | | |
|---|---|---|---|
| 54119 | 5/1978 | Japan | 148/12 F |
| 119219 | 10/1978 | Japan | 148/12 F |
| 2749 | 1/1980 | Japan | 148/12 F |
| 79827 | 6/1980 | Japan | 148/12 F |

OTHER PUBLICATIONS

Hamre, "Properties of Acicular-Ferrite Steel for Large-Diameter Line Pipe", Micro Alloying 75, Conf. Wash., D.C., Session 2B, Oct. 1975, pp. 21-27.

Civallero, "Production of Large-Diameter High-Strength, Low Alloy Pipe in Italy", Micro Alloying 75, Conf. Wash., D.C., Session 2B, Oct. 1975, pp. 81, 93-95.

Morcinek, "Structural Steels with Acicular Ferrite", Micro Alloying 75, Conf. Wash., D.C., Oct. 1975, Session 2A, pp. 41-47.

*Primary Examiner*—Peter K. Skiff

*Attorney, Agent, or Firm*—Frost & Jacobs

[57] ABSTRACT

Low alloy steel shape of at least 3/16 inch thickness is produced by providing a steel consisting essentially of from about 0.02% to 0.07% carbon, 1.2% to 2.0% manganese, 0.020% maximum sulfur, up to 0.5% silicon, 0.1% to 0.4% molybdenum, 0.01% to 0.1% columbium, about 0.01% to 0.010% acid soluble aluminum, about 0.8% to 2.0% copper, about 0.4% to 2.0% nickel, residual chromium, and balance iron; hot reducing the steel to a desired final thickness with a total reduction in thickness of at least 30% while within the temperature range of about 1400° to 1700° F. whereby to avoid substantial recrystallization of austenite and to obtain a predominant heavily deformed austenite phase; and cooling at a rate which transforms the austenite phase to a predominantly fine acicular ferrite and lower-bainite phase. The steel may also be precipitation hardened, or may be hot reduced either by the above-described controlled hot reduction or by conventional hot reduction, austenitized, quenched, and precipitation hardened. The product has high strength, improved low temperature toughness and excellent weldability.

7 Claims, 6 Drawing Figures

PHOTOMICROGRAPHS OF MICROSTRUCTURES IN AS-ROLLED PLATES OF HEAT AT MID-THICKNESS IN 3/4" PLATES
CONTROL
ROLLING DIRECTION
200 X NITAL ETCH
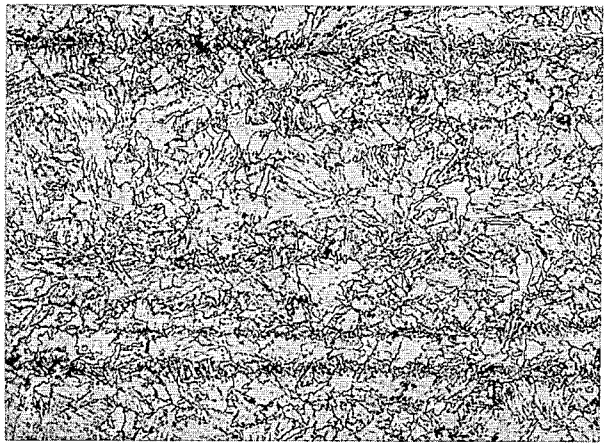
CONVENTIONAL
FIG. 5

PHOTOMICROGRAPHS OF MICROSTRUCTURES IN CONTROLLED HOT ROLLED PLATES
MID-THICKNESS POSITION IN 1/2" PLATES

STEEL OF PRESENT INVENTION (HT. A)

ROLLING DIRECTION
200X NITAL ETCH

ASTM A70 GR A CL. I STEEL (HT. B)

LOW ALLOY STEEL PLATE AND PROCESS FOR PRODUCTION THEREOF

This application is a continuation of application Ser. No. 476,353, filed Mar. 17, 1983, abandoned.

BACKGROUND OF THE INVENTION

This invention relates to a low alloy steel shape of at least 3/16 inch (4.8 mm) thickness having improved yield strength, toughness and excellent weldability, and to a novel process for the production thereof.

The steel shape of the invention may be produced, from a casting or previously rolled slab as a starting material, in the form of plate, bar, tube and structural shape, as hot reduced, hot reduced and precipitation hardened, or hot reduced, austenitized, quenched and precipitation hardened products. Although not so limited, the invention has particular utility in the production of plate of at least 3/16 inch thickness which retains good toughness in the heat affected zone of weldments made by any of the usual welding processes.

Steel plate hot rolled in accordance with the process of the invention exhibits a yield strength of at least 80 ksi (56 kg/mm$^2$) at room temperature and a Charpy V-notch impact strength of at least 20 ft-lbs (27 Joules) in the longitudinal direction at −50° F. (−46° C.). When hot rolled in accordance with the process of the invention and precipitation hardened, steel plate exhibits a yield strength of at least 85 ksi (60 kg/mm$^2$)at room temperature and a Charpy V-notch impact strength of at least 20 ft-lbs (27 Joules) longitudinal at −50° F. (−46° C.). When hot rolled in conventional manner, austenitized, quenched and precipitation hardened, the steel plate of the invention has a yield strength of at least 80 ksi (56 kg/mm$^2$) at room temperature and a Charpy V-notch impact strength of at least 50 ft-lbs (68 Joules) longitudinal at −80° F. (−62° C.).

British Pat. No. 1,436,846, published May 26, 1976, discloses a steel alleged to exhibit good weldability and high strength containing from 0.4 to 0.8% nickel, 0.7 to 1.1% copper, 0.01 to 0.09% carbon, 0.02 to 0.1% niobium, 1.1 to 1.65% manganese, 0 to 0.5% chromium, 0 to 0.6% silicon, 0 to 0.5% molybdenum, 0 to 0.01% boron, 0 to 0.08% aluminum, 0 to 0.1% total of at least one of zirconium, magnesium, calcium, and rare earth metals, and balance iron except for impurities. Exemplary steels are stated to have a yield strength of at least 450 MN/m$^2$ (65 ksi) and a toughness level such that the 70 J transition temperature is below −10° C. when the hot rolled plate is finished at a temperature up to 1050° C. Hot rolling finishing temperatures ranged from 950° to 1050° C. in the specific examples.

ASTM A710 Grade B steel is based on U.S. Pat. No. 3,132,025, issued to Hurley May 5, 1964, which discloses a low alloy structural steel alleged to exhibit in the hot rolled condition an excellent combination of metallurgical properties. The steel contains up to 0.08% carbon, about 0.2 to 0.75% manganese, up to 0.35% silicon, about 1 to 1.7% copper, about 0.7 to 1.6% nickel, about 0.01 to 0.16% columbium (niobium) and balance essentially iron. Up to 0.1% aluminum may also be present. The steel is stated to exhibit a yield strength of at least 70 ksi at room temperature, a Charpy V-notch impact strength of at least 15 ft-lbs at −50° F. and a reduction of area of at least 60%. The steel is processed by heating above about 2000° F., hot rolled and finished at about 1650° F. A precipitation-hardening treatment can also be applied by heating between about 850° and 1150° F. for about 1 hr.

U.S. Pat. No. 3,945,858, issued Mar. 23, 1976 to Matsubara et al, discloses a low alloy steel alleged to have high notch toughness at low temperature, comprising 0.02 to 0.10% carbon, 1.20 to 1.80% manganese, less than 0.015% sulfur, 0.05 to 0.50% chromium, 0.01 to 0.10% niobium, 0.10 to 0.50% silicon, less than 0.030% phosphorus, 0.05 to 0.50% nickel, 0.05 to 0.50% copper and balance iron and unavoidable impurities. A rare earth metal or alloy may be added within the range of 0.01 to 0.20%. The steel is hot rolled with a reduction in thickness of from 30 to 80% at a temperature below 950° C. (1742° F.). This is alleged to result in improved notch toughness.

U.S. Pat. No. 3,955,971, issued May 11, 1976 to Reisdorf, discloses a low alloy structural steel having good low temperature properties, such as a minimum yield strength of at least 60 ksi and good impact toughness down to temperatures as low as −80° F. The steel comprises 0.06 to 0.12% carbon, 0.20 to 1.00% manganese, 0.020% maximum phosphorus, 0.015% maximum sulfur, 0.15 to 0.40% silicon, 0.75 to 1.50% nickel, 0.50 to 1.25% chromium, 0.15 to 0.40% molybdenum, 0.010 to 0.060% aluminum, 0.75% maximum copper with copper plus chromium being 1.50% maximum, and balance iron and conventional impurities. In the processing of exemplary 1 and 2 inch thick plates, samples were austenitized at 1650° F., water quenched, and then tempered at 1150°, 1200° and 1250° F.

Other prior art or which applicant is aware includes U.S. Pat. Nos. 3,692,514, 3,841,866; 3,849,209 and 4,008,103, and Canadian Pat. No. 988,751.

ASTM alloy A710, Grade A, has an analysis, in weight percent, of 0.07% maximum carbon, 0.40 to 0.70% manganese, 0.025% maximum phosphorus, 0.025% maximum sulfur, 0.40% maximum silicon, 0.70 to 1.00% nickel, 0.60 to 0.90% chromium, 0.15 to 0.25% molybdenum, 1.00 to 1.30% copper, 0.02% minimum columbium, and balance iron. This composition is based on the above-mentioned U.S. Pat. No. 3,692,514.

Despite the numerous prior art developments in the field of low alloy steel plate for structural purposes, there is still a need for such a steel in plate form, particularly in thicknesses of 3/16 to 2" (4.8 to 51 mm), which consistently exhibits a yield strength of at least 80 ksi at room temperature, a Charpy V-notch impact strength of at least 20 ft-lbs (longitudinal) and at least 15 ft-lbs (transverse) at −50° F. in the hot rolled condition; a yield strength of at least 85 ksi and a Charpy V-notch impact strength of at least 20 ft-lbs (longitudinal) and at least 15 ft-lbs (transverse) at −50° F. in the rolled and precipitation hardened condition; and a yield strength of at least 80 ksi and a Charpy V-notch impact strength of at least 50 ft-lbs (longitudinal) and at least 35 ft-lbs (47 Joules) (transverse) at −80° F. in the quenched and precipitation hardened condition, together with excellent weldability, particularly retention of toughness in the heat affected zone of a weldment made by any of the usual welding processes.

SUMMARY OF THE INVENTION

It is an object of the invention to provide a process for producing low alloy steel plate by controlled hot rolling, which plate will possess adequate mechanical and metallurgical properties for most applications in the as-hot rolled condition.

It is a another object of the invention to provide a process for producing low alloy steel plate of at least 3/16 inch thickness by controlled hot rolling and precipitation hardening which has the novel combination of properties described above.

It is a further object of the invention to provide a process for producing low alloy steel plate in the quenched and precipitation hardened condition which exhibits improved strength and low temperature toughness.

It is another object of the present invention to provide low alloy steel plate of at least 3/16 inch thickness having the above described combination of properties not now available in the prior art.

According to the invention there is provided a process for producing a low alloy steel shape of at least 3/16 inch thickness exhibiting a yield strength of at least 80 ksi at room temperature and a Charpy V-notch impact strength (longitudinal) of at least 20 ft-lbs at −50° F. in the hot reduced condition together with excellent weldability including retained toughness in the heat affected zone of a weldment, comprising the steps of providing a steel starting material consisting essentially of, in weight percent, from about 0.02% to 0.07% carbon, 1.2% to 2.0% manganese, 0.020% maximum sulfur, up to 0.5% silicon, 0.1% to 0.4% molybdenum, 0.01% to 0.1% columbium, about 0.01% to 0.10% acid soluble aluminum, about 0.8% to 2.0% copper, about 0.4% to 2.0% nickel, residual chromium, and balance iron except for incidental impurities; hot reducing said starting material to a desired final thickness with a total reduction in thickness of at least 30% while within the temperature range of about 1400° to 1700° F. (760° to 927° C.) whereby to avoid substantial recrystallization of austenite and to obtain a predominant heavily deformed austenite phase; and cooling at a rate which transforms said austenite phase to a predominantly fine acicular ferrite and lower-bainite phase.

The invention further provides a process for producing a low alloy steel plate as set forth hereinabove, and including the further step of precipitation hardening the hot reduced shape by heating within the range between about 900° F. (482° C.) and the $A_{C1}$ point, whereby to obtain a shape having a yield strength of at least 85 ksi (60 kg/mm$^2$) at room temperature and a Charpy V-notch impact strength (longitudinal) of at least 20 ft-lbs at −50° F.

In a further embodiment of the invention there is provided a process for producing a low alloy steel shape of at least 3/16 inch thickness exhibiting a yield strength of at least 80 ksi at room temperature and a Charpy V-Notch impact strength (longitudinal) of at least 50 ft-lbs at −80° F. in the austenitized, quenched and precipitation hardened condition together with excellent weldability including retained toughness in the heat affected zone of a weldment, comprising the steps of providing a steel starting material consisting essentially of, in weight percent, from about 0.02% to 0.07% carbon, 1.2% to 2.0% manganese, 0.020% maximum sulfur, up to 0.5% silicon, 0.1% to 0.4% molybdenum, 0.01% to 0.1% columbium, about 0.01% to 0.10% acid soluble aluminum, about 0.8% to 2.0% copper, about 0.4% to 2.0% nickel, residual chromium, and balance iron except for incidental impurities; hot reducing said starting material to a desired final thickness; cooling to a temperature at which the steel transforms to ferrite; reheating the hot reduced shape to a temperature of about 1600° to 1800° F. (871° to 982° C.) and within the austenization range whereby to transform said ferrite to austenite; quenching at a rate which transforms substantially all said austenite to predominantly fine acicular ferrite and lower-bainite and which avoids substantial precipitation of copper-rich particles; and precipitation hardening by heating within the range between about 900° F. (482° C.) and the $A_{C1}$ point.

The invention further provides a low alloy steel shape of at least 3/16 inch thickness exhibiting a yield strength of at least 80 ksi at room temperature and a Charpy V-notch impact strength (longitudinal) of at least 20 ft-lbs at −50° F. in the hot reduced condition, together with excellent weldability including retained toughness in the heat affected zone of a weldment, said steel consisting essentially of, in weight percent, from about 0.02% to 0.07% carbon, 1.2% to 2.0% manganese, 0.020% maximum sulfur, up to 0.5% silicon, 0.1% to 0.4% molybdenum, 0.01% to 0.10% columbium, about 0.01% to 0.10% acid soluble aluminum, about 0.8% to 2.0% copper, about 0.4% to 2.0% nickel, residual chromium, and balance iron except for incidental impurities.

When in the precipitation hardened condition, the low alloy steel shape defined above exhibits a yield strength of at least 85 ksi at room temperature and a Charpy V-notch impact strength (longitudinal) of at least 20 ft-lbs at −50° F.

When austenitized, quenched and precipitation hardened, the low alloy steel shape of the invention as defined above exhibits a yield strength of at least 80 ksi at room temperature and a Charpy V-notch impact strength (longitudinal) of at least 50 ft-lbs at −80° F.

BRIEF DESCRIPTION OF THE DRAWING

Reference is made to the accompanying drawing wherein:

FIG. 1 is a graphic comparison of tensile properties vs. plate thickness of a steel of the invention with ASTM A710 Grade A and a similar steel containing substantially no molybdenum;

FIG. 2 is a graphic comparison of ductile-to-brittle transition temperature vs. plate thickness of a steel of the invention with ASTM A710 Grade A and a similar steel containing substantially no molybdenum;

FIGS. 3 and 4 are photomicrographs at 200× of hot rolled plates of the steel of the invention;

DETAILED DESCRIPTION

Figures 11, 12:
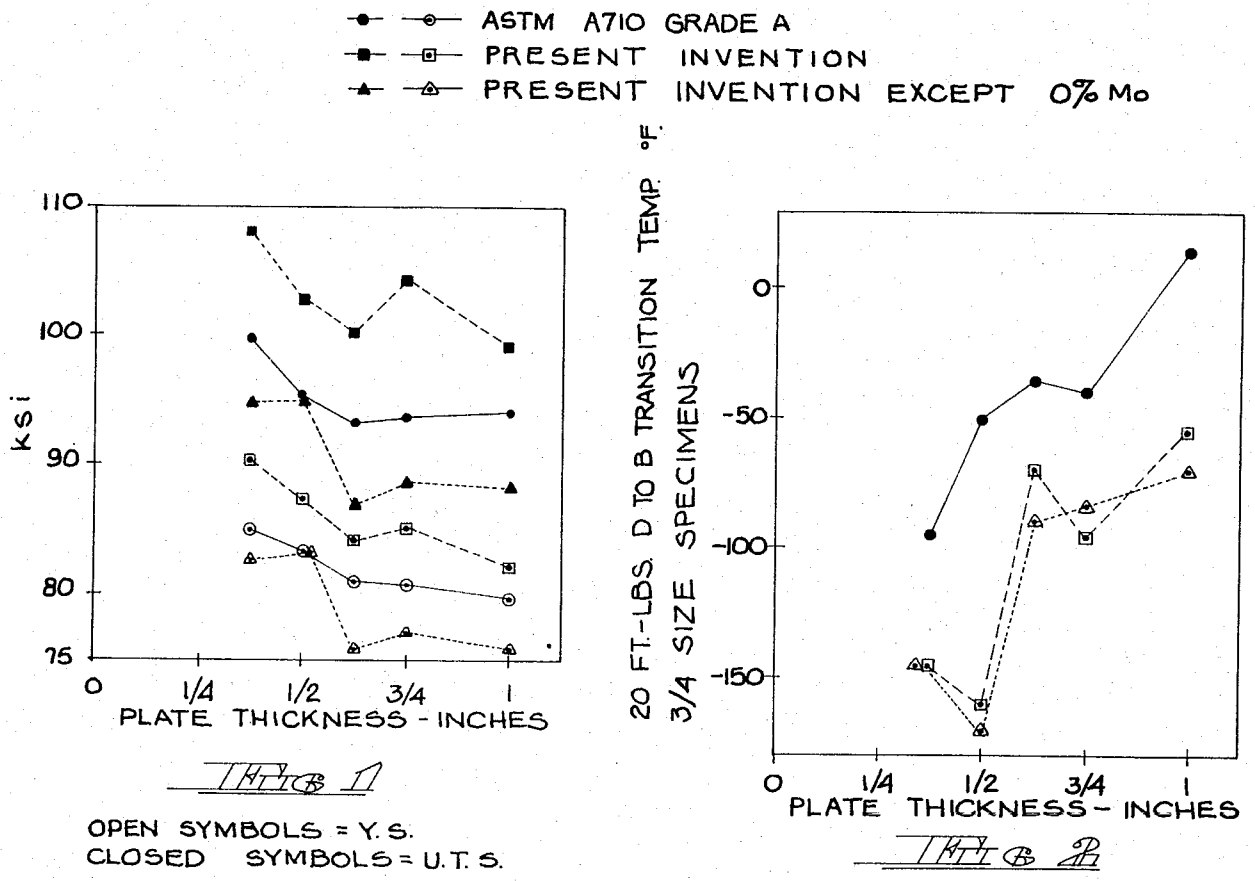

A preferred composition of the steel of the invention consists essentially of, in weight percent, from about 0.03% to 0.05% carbon, about 1.3% to 1.65% manganese, about 0.010% maximum sulfur, about 0.15% to 0.40% silicon, about 0.15% to 0.30% molybdenum, about 0.02% to 0.05% columbium, about 0.02% to 0.06% acid soluble aluminum, about 1.0% to 1.3% copper, about 0.7% to 1.0% nickel, less than 0.25% chromium, and balance iron except for incidental impurities.

Carbon is essential for its contribution to strength and a minimum of about 0.02% is needed for this purpose. However, carbon in excess of 0.07% results in a decrease in toughness and drastic impairment of weldability. Since the steel plate in final form is predominantly fine acicular ferrite and lower-bainite, carbon in excess of 0.07% would result in excessive amounts of pearlite, coarse upper-bainite, and small regions of a high carbon austenite+martensite constituent. These phases are considered to reduce toughness without any substantial strengthening. Best results are obtained within a carbon range of about 0.03% to 0.05%.

Manganese is required at a minimum of 1.2% in order to provide strength and toughness. More than 2.0% manganese can produce segregation during casting and can form martensite during welding. Manganese additives with low carbon content are also relatively expensive, and higher concentrations result in accelerated erosion of refractories during melting. A range of 1.2% to 2.0% manganese is thus considered essential, preferably about 1.3% to 1.65%.

Sulfur, commonly occurring as an impurity, must be restricted to a maximum of 0.020% in order to minimize sulfide inclusion "stringers" in the hot rolled plate which would adversely affect the ductility and toughness of the steel in the long transverse and short transverse directions. Preferably, sulfur is restricted to a maximum of 0.01%.

Silicon is added for deoxidation and provides some additional strength to the steel. However, silicon should be restricted to a maximum of 0.5% since amounts in excess of this value are detrimental to toughness and welding properties.

Molybdenum is added conventionally in order to strengthen and harden steel, and it has the same function in the steel of the present invention. However, the principal and essential reason for addition of molybdenum within the limits of 0.1% to 0.4% and preferably between about 0.15% and 0.30%, is because of its apparent interaction with columbium to control the transformation of austenite to ferrite during cooling after hot rolling or during subsequent reheating and quenching. It helps to achieve a substantially unrecrystallized austenite during low temperature hot rolling. When molybdenum is present within the specified range, columbium is more effective in retarding the recrystallization of austenite. Zirconium, vanadium and titanium do not sufficiently retard austenite recrystallization, either with or without molybdenum, and hence these alloying elements are not equivalent to columbium in the steel of the present invention. A maximum of 0.4% molybdenum should be observed since amounts in excess of this would cause martensite during welding, which is brittle and hence unacceptable. Larger molybdenum additions also raise the cost without additional strength or toughness improvements.

At least 0.01% columbium must be added in order to effect retardation of austenite recrystallization. For any columbium level, less than about 0.1% molybdenum will not produce sufficient retardation except in very thin plates. Since the present invention is directed to shapes having thicknesses greater than about 3/16 inch, a columbium range of 0.01% to 0.1%, preferably about 0.02% to about 0.05%, in combination with 0.1% to 0.4% molybdenum, is necessary. Columbium levels above about 0.1% become difficult to dissolve prior to rolling, and in such cases these additions will not give the required retardation in austenite recystallization while deforming at least 30% in the 1400° to 1700° F. range. Also, higher columbium levels raise costs, cause toughness losses and promote cracking in welds.

Aluminum is required for grain size control during processing, and at least about 0.01% in acid soluble form is needed for this purpose. Grain coarsening is detrimental to toughness and strength. Aluminum is also effective in combining with residual nitrogen which may be present, but a maximum of 0.10% acid soluble aluminum should be observed since excessive amounts adversely affect ductility.

Copper is essential as a precipitation hardening element, and a minimum of about 0.8% is necessary for this purpose. Amounts in excess of 2.0% copper are expensive, and preferably copper ranges between about 1.0% and 1.3%. Copper within this range also helps to obtain the required acicular ferrite and lower-bainite microstructure during cooling after hot rolling or quenching after austenitizing.

Nickel is present within the range of about 0.4% to 2.0% in order to avoid hot shortness during hot rolling. Since nickel is expensive, it is restricted to a maximum of 2.0%, preferably 1.0%, and amounts in excess of the broad maximum can cause welding problems.

The manganese and copper ranges of the present steel are higher than those normally used for low alloy plate steels. These higher ranges increase the strength and toughness of the steel, and manganese is further believed to function in a manner similar to that of molybdenum in making columbium more effective in retarding the recrystallization of austenite. Manganese also helps to promote the formation of fine acicular ferrite and lower-bainite.

Chromium is restricted to residual amounts (about 0.25% maximum) since chromium in combination with relatively high manganese causes formation of upper-bainite in the microstructure, which is highly detrimental to toughness. The use of chromium in prior art plate steels resulted in the sacrifice of toughness in order to obtain higher strength. In the steel of the present invention this problem is avoided. Chromium additions also cause martensite to form in welds, causing lower toughness and making hydrogen cracking more possible.

The importance of retarding austenite recrystallization during the latter stages of hot rolling is to obtain a predominantly heavily deformed austenite phase. A total reduction in thickness of at least 30% while within the temperature range of about 1400° to 1700° F. has been found to be necessary to accomplish this. The reduction in thickness may be done in one or several passes. Preferably the total reduction in thickness is at least 50% within a preferred temperature range of 1400° to 1600° F. No ferrite is formed intentionally during hot rolling in the controlled process of the present invention. At higher rolling temperatures, or in steels not containing the critical columbium, molybdenum and manganese additions, deformed grains immediately recrystallize during hot rolling after each rolling pass into undeformed or stress-free new grains, but in the present invention substantial recrystallization does not occur because of the composition of the steel. Hence, at the completion of hot rolling the austenite grains are highly deformed. During cooling after completion of hot rolling the deformed austenite structure transforms to ferrite in the usual manner, but the ferrite is predominantly fine grained and acicular rather than polygonal. The high strength and toughness of the present steel is attributed to the predominantly acicular ferrite and lower-bainite microstructure.

When producing the quenched and precipitation hardened steel plate of the present invention, it is not essential to control the hot rolling in such manner that a reduction in thickness of at least 30% is effected while within the temperature range of about 1400° to 1700° F. where austenite recrystyallization is retarded by the columbium, molybdenum and manganese additions. However, controlled hot rolling may be used. The further steps after conventional hot rolling include reheating the hot rolled plate to a temperature within the austenization range, namely about 1600° to 1800° F. and preferably within the range of about 1650° to 1700° F. (899° to 927° C.). After transformation of substantially all the ferrite phase to austenite the steel is quenched rapidly to transform austenite back to substantially all fine acicular ferrite and lower-bainite and at a rate sufficient to retain most of the copper in solid solution. The quench medium for this step should be water since media such as oil, salt or forced air probably would not provide a cooling rate sufficient to prevent precipitation of the copper as fine particles, except in thinner plate up to about ⅜ inch (9.5 mm) thickness.

The precipitation hardening step involves heating within the range between about 900° F. and the $A_{C1}$ point. At temperatures below about 900° F., copper will not precipitate within a reasonable time period, and any small amount of martensite which forms will not be adequately tempered. On the other hand, if heated to above the $A_{C1}$ temperature, i.e. about 1300° F., some austenite will again form which can transform to embrittling martensite upon subsequent air cooling. It is also necessary to avoid precipitation of copper during a preceding quenching step since such premature precipitation would result in no contribution to strength. This is the reason for requiring a quench rate sufficiently rapid to retain the copper in solid solution. Preferably the precipitation hardening temperature range is between about 1000° and 1200° F. (538° and 649° C.).

When producing low alloy steel plate in the as hot rolled condition in accordance with the controlled hot rolling process of the present invention a yield strength of at least 80 ksi at room temperature is obtained without the necessity for precipitation hardening or other strengthening step as is presently required for ASTM A710 Grade A Class 1 alloy steels. This provides reduction in processing costs, and improved surface since less scale is produced. Better flatness is also obtained, particularly in wide, relatively thin plate within the range of 3/16 to ⅜ thickness. At the same time good toughness in both the longitudinal and transverse directions is achieved.

Referring to FIGS. 1 and 2 of the drawing, tensile and toughness properties are plotted for steels which have been subjected to the controlled hot rolling process of the present invention and precipitation hardened. It is evident from FIG. 1 that a steel of the invention exhibits substantially higher tensile and yield strengths than ASTM A710 Grade A and a steel otherwise within the ranges of the present steel except for omission of molybdenum. Similarly, FIG. 2 discloses a ductile-to-brittle transition temperature for the steel of the invention substantially superior to that of ASTM A710 Grade A and comparable to that of the steel otherwise within the ranges of the present invention except for omission of molybdenum.

After preliminary laboratory tests, which are not reported herein, a series of production trials was conducted. As summarized in Table I, Heat A was prepared with all essential elements within the preferred ranges of the steel of the invention. Slabs from this heat were hot rolled to plate of varying thicknesses using both conventional hot rolling and the controlled hot rolling process of the present invention. The slab reheating temperature for hot rolling was within the range of 2250° to 2350° F. (1232° to 1288° C.). Controlled rolling in these trials involved 65% to 70% reduction in thickness at temperatures between 1500° and 1700° F. Hot roll finish temperatures were between about 1450° and 1500° F. Conventional hot rolling involved only small reductions below 1700° F. and finish temperatures at about 1600° F. Samples of all thicknesses were further subjected to precipitation hardening after hot rolling at a temperature of 1100° F. (593° C.) for a period of one hour, followed by air cooling.

As shown in Table I, in the as-rolled condition, samples which were subjected to the controlled hot rolling process of the invention showed a slight superiority in yield and tensile strength over samples subjected to conventional hot rolling. Of greater significance was the dramatic superiority in toughness in the as-rolled condition exhibited by all samples subjected to the controlled hot rolling process of the invention.

The precipitation hardened samples exhibited a significant increase in yield and tensile strength as compared to the same samples in the as-rolled condition, and samples subjected to the controlled hot rolling process of the invention were slightly superior in yield strength as compared to precipitation hardened samples subjected to conventional hot rolling. Again the toughness of samples in the precipitation hardened condition subjected to controlled hot rolling showed a marked superiority over samples which were subjected to conventional hot rolling prior to precipitation hardening.

For purposes of direct comparison, samples of Heat A were subjected to the same tests as Heat B of ASTM A710 Grade A steel, analyzing, in weight percent, 0.035% carbon, 0.44% manganese, 0.010% phosphorus, 0.015% sulfur, 0.28% silicon, 0.68% chromium, 0.89% nickel, 0.21% molybdenum, 1.16% copper, 0.044% aluminum, 0.045% columbium, and balance essentially iron. Samples of both heats were hot rolled in accordance with the controlled rolling process of the present invention to plates of ½ inch (12.7 mm) thickness, and a sample of each steel was also subjected to precipitation hardening at 1100° F. (593° C.) for one hour. In other respects preparation was the same as reported above.

The comparative transverse tensile properties and longitudinal and transverse toughness values are set forth in Table II. It is apparent that the yield strength of Heat A in the as-control rolled condition was substantially equivalent to that of Heat B in the precipitation hardened condition. In the precipitation hardened condition the yield strength of Heat A was substantially higher than that of Heat B. The toughness of the steel of the invention in the longitudinal direction was substantially higher in the as-control rolled condition than that of Heat B in the precipitation hardened condition.

Additional heats of steels in accordance with the invention were prepared, and the compositions thereof are set forth in Table III.

Samples of steels from Heats C and D in Table III and of Heat A were subjected to both conventional and controlled hot rolling, austenitizing, quenching and precipitation hardening. Plates of varying thickness were produced for testing. The austenitizing was effected by reheating to a temperature of about 1650° F. (900° C.), holding for about 30 to 75 minutes and quenching in water. Precipitation hardening was effected either at 1200° F. or 1100° F. for 30 minutes, followed by air cooling. Tensile and toughness properties of these specimens are set forth in Table IV, from which it will be noted that a yield strength in excess of 90 ksi was obtained at least for plate thicknesses up to and including one inch. For the thicker plates wherein the yield strength ranged between 86.4 and 88.3 ksi, somewhat higher yield strengths could undoubtedly be obtained by precipitation hardening at 1000° F. (538° C.).

It will be evident that outstanding toughness was achieved in the longitudinal direction for all specimens regardless of whether the hot rolling was conventional or conducted in accordance with the controlled hot rolling process of the present invention. Transverse toughness values were also generally excellent and well above the aim of 35 ft-lbs at −80° F.

Figure 4A:
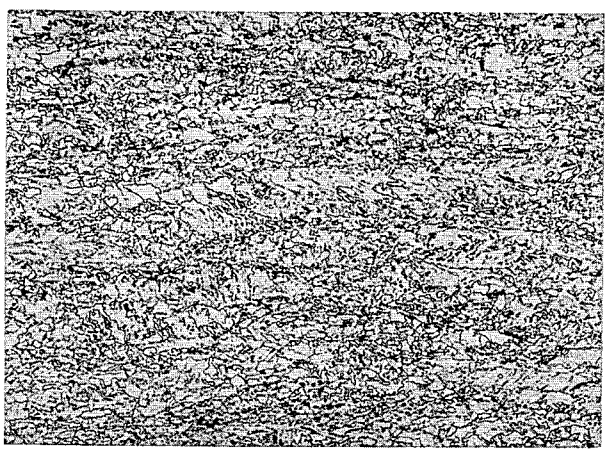

Referring next to FIGS. 3 and 4, microstructures are shown of specimens taken from the steel of Heat A at the mid thickness of ¾ inch (19 mm) thick plates. FIG. 3 illustrates the recrystallized grain structure obtained in the as-rolled condition when subjected to conventional hot rolling. FIG. 4 shows the deformed grain structure obtained by the controlled hot rolling process of the present invention, which is predominantly fine grained and acicular ferrite.

Figure 5:
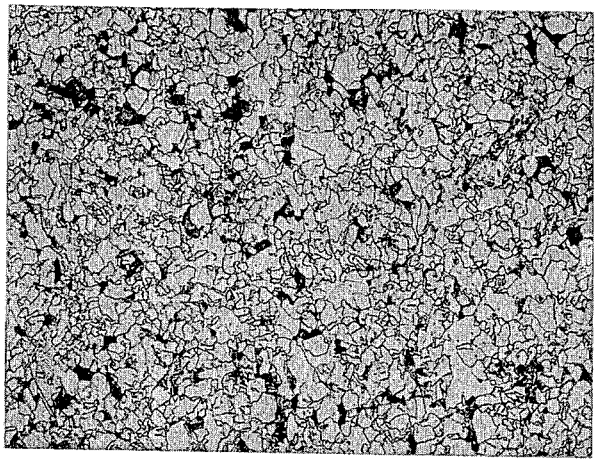
FIG. 5 is a photomicrograph at 200× of hot rolled ASTM A710 Grade A.

FIG. 5 illustrates the grain structure of an ASTM A710 Grade A steel (Heat B) after hot rolling in accordance with the controlled hot rolling process of the present invention, with the specimen being taken at the mid thickness position of ½ inch plate. The microstructure comprises polygonal ferrite, pearlite and bainite which resulted from recrystallized austenite before transformation.

Figure 6:
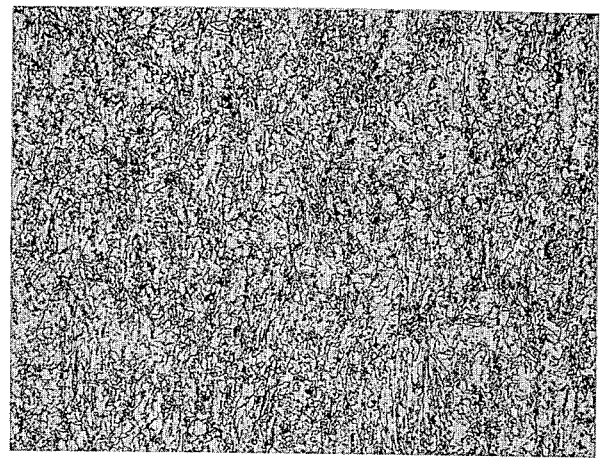
FIG. 6 is a photomicrograph at 200× of hot rolled steel of the invention.

FIG. 6 illustrates the microstructure of the steel of the invention (Heat No. A), taken at the mid thickness position of ½ inch plate when subjected to the controlled hot rolling process of the present invention. The microstructure is a very fine acicular ferrite with some lower-bainite obtained by transformation from an austenite phase which had not completely recrystallized.

In FIGS. 3 and 4 the same steel was subjected to different hot rolling conditions, and the marked difference in microstructures shows the criticality of the controlled hot rolling process of the invention when practiced on a steel of the specified composition in the as-rolled condition. In FIGS. 5 and 6, different steels were subjected to the identical controlled hot rolling process of the invention, and the steel of the present invention transformed to a very fine acicular ferrite microstructure, whereas the conventional prior art steel transformed to a polygonal ferrite, pearlite and bainite microstructure, thus illustrating the criticality of the composition of the present steel.

It is thus evident that the present invention involves criticality with respect to composition regardless of the condition of the final product. It is further evident that the controlled hot rolling process of the invention is critical for production of as-rolled and as-rolled and precipitation hardened plates having the desired combination of properties. For the production of austenitized, quenched and precipitation hardened shapes, the hot rolling process is not critical.

TABLE I

TENSILE AND TOUGHNESS PROPERTIES

Chemical Composition, wt. %

| Heat | C | Mn | P | S | Si | Cr | Ni | Mo | Cu | Al | Cb |
|---|---|---|---|---|---|---|---|---|---|---|---|
| A | 0.04 | 1.45 | 0.014 | 0.007 | 0.30 | 0.06 | 0.96 | 0.20 | 1.14 | 0.036 | 0.041 |

| Thickness inch | Rolling | As-Rolled YS, ksi | As-Rolled UTS, ksi | As-Rolled % Elong. in 8" | As-Rolled % RA | As-Rolled + 1100° F. P.H. YS, ksi | As-Rolled + 1100° F. P.H. UTS, ksi | As-Rolled + 1100° F. P.H. % Elong. in 2" | As-Rolled + 1100° F. P.H. % RA |
|---|---|---|---|---|---|---|---|---|---|
| 3/8 | Conventional | 87.6 | 103.0 | 18 | 53 | ND* | 117.8 | 33 | 57 |
| 3/8 | Present Invention | 86.2 | 106.0 | 14 | 49 | 104.9 | 114.8 | 29 | 46 |
| ½ | Present Invention | 81.9 | 105.4 | 13.5 | 55 | 107.5 | 116.2 | 41 | 57 |
| ¾ | Conventional | 82.1 | 102.9 | 18 | 54 | 103.7 | 117.8 | 42 | 52 |
| ¾ | Present Invention | 83.5 | 104.4 | 18 | 51 | 99.9 | 107.9 | 46 | 58 |
| ¾ | Conventional | 83.3 | 104.6 | 18 | 60 | 97.9 | 113.4 | 40 | 55 |
| ¾ | Present Invention | 84.2 | 105.3 | 18 | 50 | 98.1 | 110.4 | 39 | 51 |

*ND = not determined

Charpy V-Notch Impact Energy at −50° F.

| Thickness inch | Rolling | Energy, ft-lb - As rolled* Specimen | Energy, ft-lb - As rolled* Longitudinal | Energy, ft-lb - As rolled* Transverse | Energy, ft-lb - As-Rolled + 1100° F. PH* Specimen | Energy, ft-lb - As-Rolled + 1100° F. PH* Longitudinal | Energy, ft-lb - As-Rolled + 1100° F. PH* Transverse |
|---|---|---|---|---|---|---|---|
| 3/8 | Conventional | ¾-size | 31 | 19 | ¾-size | 26 | 19 |
| 3/8 | Present Invention | " | 65 | 38 | " | 55 | 31 |
| ½ | Present Invention | Full-size | 78 | 46 | Full-size | 45 | 23 |
| ¾ | Conventional | " | 6 | 10 | " | 14 | 10 |
| ¾ | Present Invention | " | 37 | 43 | " | 67 | 32 |
| ¾ | Conventional | " | 18 | 15 | " | 26 | 15 |
| ¾ | Present Invention | " | 69 | 50 | " | 76 | 31 |

*Average of three replicate tests

TABLE II

Transverse Tensile Properties - 12.5 mm Plates Rolled According to Present Invention

| Heat | Test Condition | YS, ksi | UTS, ksi | % Elong. in 8" | % Elong. in 2" |
|---|---|---|---|---|---|
| A | As-Rolled | 81.9 | 105.4 | 13.5 | ND |
| " | As-Rolled + 1100° F. PH | 107.5 | 116.2 | ND | 41 |
| B | As-Rolled + 1100° F. PH | 83.3 | 98.8 | ND | 31 |

ND = Not Determined

Longitudinal and Transverse Charpy V-Notch Impact Energy at −50° F.

| Heat | Test Condition | Energy, ft-lb* Specimen | Energy, ft-lb* Longitudinal | Energy, ft-lb* Transverse |
|---|---|---|---|---|
| A | As-Rolled | Full-size | 78 | 46 |
| " | As-Rolled + 1100° F. PH | " | 45 | 23 |

TABLE II-continued

| | | | | |
|---|---|---|---|---|
| B | As-Rolled + 1100° F. PH | " | 56 | ND |

*Average of three replicate specimens for Heat A and two for Heat B
ND = Not Determined

TABLE III

| | Chemical Composition, wt. % | | | | | | | | | | |
|---|---|---|---|---|---|---|---|---|---|---|---|
| Heat | C | Mn | P | S | Si | Cr | Ni | Mo | Cu | Al | Cb |
| C | 0.06 | 1.40 | 0.010 | 0.004 | 0.24 | 0.08 | 0.85 | 0.18 | 1.14 | 0.050 | 0.044 |
| D | 0.05 | 1.42 | 0.010 | 0.005 | 0.30 | 0.23 | 0.87 | 0.17 | 1.13 | 0.033 | 0.050 |

TABLE IV

TENSILE & TOUGHNESS PROPERTIES OF WATER QUENCHED PLATES

| Heat | Plate Thickness inch | Rolling | PH Temperatures | YS, ksi | UTS, ksi | % Elong. in 2" | % RA |
|---|---|---|---|---|---|---|---|
| A | 3/8 | Conventional | 1200° F. | ND | 96.0 | 44 | 58 |
| " | 3/8 | Present Invention | " | 98.3 | 104.7 | 31 | 65 |
| " | 1/2 | Present Invention | " | 98.3 | 104.6 | 36 | 63 |
| " | 3/4 | Conventional | " | 88.1 | 98.6 | 48 | 65 |
| " | 3/4 | Present Invention | " | 94.7 | 101.8 | 38 | 47 |
| C | 1 | Conventional | 1100° F. | 95.9 | 101.4 | 24 | 69 |
| A | 1 1/4 | Conventional | 1200° F. | 88.3 | 96.7 | 55 | 63 |
| D | 1 1/4 | Conventional | 1100° F. | 87.0 | 98.0 | 25 | 67 |
| " | 2 | Conventional | " | 86.4 | 98.9 | 25 | 72 |

ND = Not Determined

Charpy V-Notch Impact Energy at −80° F.

| Heat | Plate Thickness inch | Rolling | PH Temperatures | Energy, ft-lb* Specimen | Longitudinal | Transverse |
|---|---|---|---|---|---|---|
| A | 3/8 | Conventional | 1200° F. | 3/4-size | 92 | 35 |
| " | 3/8 | Present Invention | " | " | 97 | 58 |
| " | 1/2 | Present Invention | " | Full-size | 129 | 62 |
| " | 3/4 | Conventional | " | " | 107 | 81 |
| " | 3/4 | Present Invention | " | " | 90 | 61 |
| C | 1 | Conventional | 1100° F. | " | 119 | 98 |
| A | 1 1/4 | Conventional | 1200° F. | " | 112 | 79 |
| D | 1 1/4 | Conventional | 1100° F. | " | 106 | 68 |
| " | 2 | Conventional | " | " | 92 | 60 |

*Average of three replicate tests ND = Not Determined

I claim:

1. A process for producing a low alloy steel shape of at least 3/16 inch thickness exhibiting a yield strength of at least 80 ksi at room temperature and a Charpy V-Notch impact strength (longitudinal) of at least 50 ft-lbs (68 Joules) at −80° F. (−62° C.) in the austenitized, quenched, and precipitation hardened condition together with excellent weldability including retained toughness in the heat affected zone of a weldment, comprising the steps of providing a steel starting material consisting essentially of, in weight percent, from about 0.02% to 0.07% carbon, 1.2% to 2.0% manganese, 0.020% maximum sulfur, up to 0.5% silicon, 0.1% to 0.4% molybdenum, 0.01% to 0.1% columbium, about 0.01% to 0.10% acid soluble aluminum, about 0.8% to 2.0% copper, about 0.4% to 2.0% nickel, residual chromium, and balance iron except for incidental impurities; hot reducing said starting material to a desired final thickness; cooling to a temperature at which the steel transforms to ferrite; reheating the hot reduced shape to a temperature of about 1600° to 1800° F. (871° to 982° C.) and within the austenization range whereby to transform said ferrite to austenite; quenching at a rate which transforms substantially all said austenite to predominantly fine acicular ferrite and lower-bainite and which avoids substantial precipitation of copper-rich particles; and precipitation hardening by heating within the range between about 900° F. and the $A_{C1}$ point.

2. The process claimed in claim 1, wherein said hot reduced shape is reheated to a temperature of about 1650° to 1700° F. (899° to 927° C.) and wherein said precipitation hardening comprises heating within the range between about 1000° and 1200° F. (538° and 649° C.).

3. The process claimed in claim 1, wherein said steel consists essentially of from about 0.03% to 0.05% carbon, about 1.3% to 1.65% manganese, about 0.01% maximum sulfur, about 0.15% to 0.40% silicon, about 0.15% to 0.30% molybdenum, about 0.02% to 0.05% columbium, about 0.02% to 0.06% acid soluble aluminum, about 1.0% to 1.3% copper, about 0.7% to 1.0% nickel, less than 0.25% chromium, and balance iron except for incidental impurities.

4. The process claimed in claim 1, wherein said hot reducing step comprises a reduction in thickness of at least 30% while within the temperature range of about 1400° to 1700° F. whereby to avoid substantial recrystallization of austentite and to obtain a predominant heavily deformed austenite phase.

5. Precipitation hardened low alloy steel shape of at least 3/16 inch thickness having a predominantly acicular ferrite and lower-bainite microstructure, exhibiting a yield strength of at least 85 ksi at room temperature and a Charpy V-notch impact strength (longitudinal) of at least 50 ft-lb at −80° F., together with excellent weldability including retained toughness in the heat affected zone of a weldment, said steel consisting essentially of, in weight percent, from about 0.02% to 0.07% carbon, from 1.2% to 2.0% manganese, 0.020% maximum sulfur, up to 0.5% silicon, 0.1% to 0.4% molybdenum, 0.01% to 0.1% columbium, about 0.01% to 0.10% acid soluble aluminum, about 0.8% to 2.0% copper, about 0.4% to 2.0% nickel, residual chromium and balance iron except for incidental impurities.

6. Low alloy steel shape as claimed in claim 5, wherein said steel consists essentially of from about 0.03% to 0.05% carbon, about 1.3% to 1.65% manganese, about 0.01% maximum sulfur, about 0.15% to 0.40% silicon, about 0.15% to 0.30% molybdenum, about 0.02% to 0.05% columbium, about 0.02% to 0.06% acid soluble aluminum, about 1.0% to 1.3% copper, about 0.7% to 1.0% nickel, less than 0.25% chromium, and balance essentially iron.

7. Low alloy steel shape as claimed in claim 5, in the form of hot rolled plate having a thickness up to at least 2 inches.

* * * * *